US009279633B2

(12) United States Patent
Hayes

(10) Patent No.: US 9,279,633 B2
(45) Date of Patent: Mar. 8, 2016

(54) MULTI-CALIBER WEAPON

(71) Applicant: Richard R. Hayes, Toms River, NJ (US)

(72) Inventor: Richard R. Hayes, Toms River, NJ (US)

( * ) Notice: Subject to any disclaimer, the term of this patent is extended or adjusted under 35 U.S.C. 154(b) by 0 days.

(21) Appl. No.: 14/543,127

(22) Filed: Nov. 17, 2014

(65) Prior Publication Data

US 2015/0204629 A1 Jul. 23, 2015

Related U.S. Application Data

(60) Provisional application No. 61/929,678, filed on Jan. 21, 2014.

(51) Int. Cl.

| | |
|---|---|
| ***F41A 21/00*** | (2006.01) |
| ***F41A 21/10*** | (2006.01) |
| ***F41A 21/20*** | (2006.01) |
| *F41A 21/16* | (2006.01) |

(52) U.S. Cl.

CPC ..... *F41A 21/10* (2013.01); *F41A 21/20* (2013.01); *F41A 21/16* (2013.01)

(58) Field of Classification Search

CPC ..... F41A 11/02; F41A 21/10; F41A 21/00; F41A 21/16

USPC ..... 42/76.01–78

See application file for complete search history.

(56) References Cited

U.S. PATENT DOCUMENTS

| | | | | |
|---|---|---|---|---|
| 3,468,216 | A * | 9/1969 | Charpentier | 89/8 |
| 4,485,721 | A | 12/1984 | Shankla et al. | |
| 4,747,225 | A | 5/1988 | Gstettner et al. | |
| 6,352,740 | B1 | 3/2002 | Warnecke | |
| 6,571,501 | B1 | 6/2003 | Jennings | |
| 6,889,464 | B2 | 5/2005 | Degerness | |
| 7,631,453 | B2 | 12/2009 | Longueira | |
| 8,959,821 | B1 * | 2/2015 | Calvert | 42/78 |
| 2014/0007857 | A1 * | 1/2014 | Schlosser | 124/81 |

FOREIGN PATENT DOCUMENTS

| | | |
|---|---|---|
| EP | 0602877 | 6/1994 |

* cited by examiner

*Primary Examiner* — Samir Abdosh

(74) *Attorney, Agent, or Firm* — Powley & Gibson, P.C.; Robert Powley; Fritz Klantschi

(57) ABSTRACT

The present invention provides a barrel device capable of using various calibers of flanged centerfired ammunition in a breech loaded firearm. The barrel device is able to position and secure various caliber ammunition, whereby the action and firing pin will strike the center of the ammunition and cause it to be fired from the weapon. In some embodiments, the unique barrel device may comprise a non-newtonian type of fluid housed and contained in the barrel by a para-aramid synthetic material. In other embodiments, the barrel device may comprise a mechanical construct and may or may not use a synthetic fiber inner lining. In another embodiment, the barrel device may contain a foam type material to house and center the ammunition. In further embodiments, the barrel device may comprise both a non-newtonian type of fluid and a mechanical construct.

5 Claims, 6 Drawing Sheets

MULTI-CALIBER WEAPON

CROSS REFERENCE TO RELATED APPLICATIONS

This application claims the benefit of prior U.S. Provisional Application Ser. No. 61/929,678, filed Jan. 21, 2014.

BACKGROUND OF THE INVENTION

The present invention relates to the field of firearms and specifically to firearm barrels. More particularly, the present invention is relates to the rifling and lining of a weapon's barrel. Although not limited thereto, the present invention is useful in the field of small arms (definition of a small arms are those carried by a single person) being able to fire many types of ammunition or cartridges.

Current firearms use ammunition or a cartridge of a particular size or caliber that has been specifically matched to a weapon and vice-a-versa. The weapon or firearm will have a specific barrel diameter, thickness and bore size for that caliber ammunition. The match between barrel and cartridge dimensions is made so the cartridge is seated correctly in the barrel allowing the bullet of the cartridge to safely exit the barrel when the cartridge's primer is detonated when the gun is fired. The barrel of the current invention can use various types of cartridges ranging from calibers of centerfire .22 to .45 or be capable of using .410 to 20 gauge shotgun shells from the same weapon.

Previously if a person with a specific weapon runs out of that particular caliber ammunition, then they cannot use that weapon anymore. The following patents: U.S. Pat. Nos. 8,709,136; 8,397,416 and 5,133,142 address using more than one caliber ammunition in a single weapon but they all had to either: change out the current barrel to a new barrel that could fire the new cartridge type or insert some type of sleeve/claw for the new round. U.S. Pat. No. 8,069,600 developed a multi-caliber bolt, but does not disclose a barrel capable of using multi-caliber ammunition.

There have been scenarios throughout recent armed conflict history whereby lives are lost and battles turned due to insufficient gunfire due to lack of a specific ammunition caliber while usable (live) ammunition of a different caliber was still available on the battlefield. The present invention will keep the combatant in the fight. Besides military applications, applications of this weapon can be used for law enforcement and first responders.

Additionally, there are over 800 million weapons in the world today, each using a specific type of cartridge. Therefore, there exists a need for a novel firearm that will be able to use standard revolver type cartridges, including ammunition of centerfire .22 to .45 calibers. There also exists a need for a firearm to be able to utilize larger cartridges used in rifles, including 5.56 mm (standard NATO round) to 7.62 mm, and even gauges of 20 to 12 gauge.

Accordingly, there exists a need for a novel barrel construction capable of using a plurality of different cartridge types and calibers without changing the barrel or inserting a specialized sleeve, insert, or claw.

SUMMARY OF THE INVENTION

The present invention is a new barrel device that is able to use and fire many types of ammunition. The present invention comprises a novel barrel device that is capable of hosting and firing numerous calibers of ammunition from the same barrel. In preferred embodiments, the novel barrel device will be able to use most center fire, breech loaded, flanged cartridges resulting in a weapon that is both stock and action agnostic.

In some embodiments, the inside of the barrel may comprise of a para-aramid circular tube that will host flexible coiled springs (or other mechanical composition) between the inside of the gun barrel and the outside of the actual inserted ammunition.

In some embodiments, the inside of the barrel may comprise of a para-aramid circular tube that will host and secure a non-newtonian fluid between the inside of the barrel and the outside of the actual inserted ammunition.

In some embodiments, the inside of the barrel could comprise of a combination of mechanical and non-newtonian fluid. In this embodiment, the mechanical construct can be attached to the inside of the barrel and the non-newtonian fluid will be held in place by this mechanical means. This will assist in keeping the internal ballistics intact and aid in propelling the bullet out of the barrel.

Preferred embodiments of the new barrel device can be incorporated into a single "shot" handgun or break-open shotgun type style. In other embodiments, a revolver type firearm configured with a barrel device may be capable of using various types of ammunition loaded in one weapon is a natural follow-on concept and is easily conveyed.

BRIEF DESCRIPTION OF THE DRAWINGS

For the purpose of illustrating the invention, there is shown in the accompanying drawings forms that are presently preferred; it being understood that the invention is not intended to be limited to the precise arrangements and instrumentalities shown.

FIG. 1 shows a perspective view of a generic multi-caliber breach-loading (load from the rear of the barrel), break-action (barrel and action are brought together via a hinge system) type weapon.

DETAILED DESCRIPTION OF THE PREFERRED EMBODIMENTS

Figure 1:
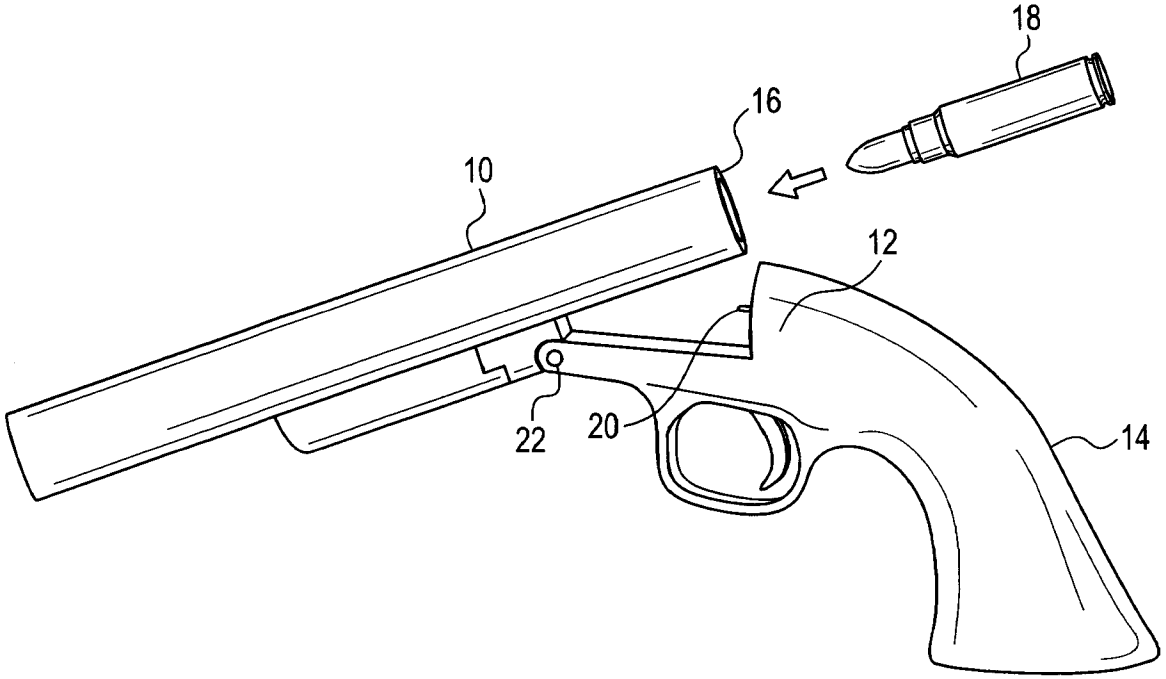
FIG. 1 shows a perspective view of one example of a multi-caliber breach-loading (load from the rear of the barrel), break-action (barrel and action are brought together via a hinge system) barrel device according to various embodiments described herein.

Referring now to the drawings in detail wherein like reference numbers represent like elements throughout the drawings, there is shown in FIG. 1 an embodiment of the present invention in the form of a generic single shot handgun/firearm. It should be readily apparent, however, that the concept of the invention can be adapted to any type of single breach-loading, bolt-action or break-action type weapon including revolvers, shotguns and rifles.

The firearm of FIG. 1 is comprised of a handle 14 connected to an action 12 that is attached to a barrel device 10. This generic firearm with the present invention's unique barrel device is brought and secured to the action 12 via a hinge pin 22. Any caliber cartridge 18 can then be loaded into the breech 16 of the barrel device. The gap between barrel device 10 and action 12 needs to be of sufficient clearance to allow the physical insertion of the cartridge 18. The barrel device 10 of the weapon has to be of adequate length, material (steel alloy is typical but can be carbon fiber or other) and thickness to accommodate the largest caliber ammunition desired, with larger caliber ammunition requiring thicker or longer barrel dimensions. Using internal ballistics (study of projectiles inside the barrel), dynamics (study of forces) and kinetic energy equations (energy of a particular cartridge), the proposed interior construction of the barrel device will need to account for the largest pressure and temperature of the largest desired cartridge.

Figure 2:
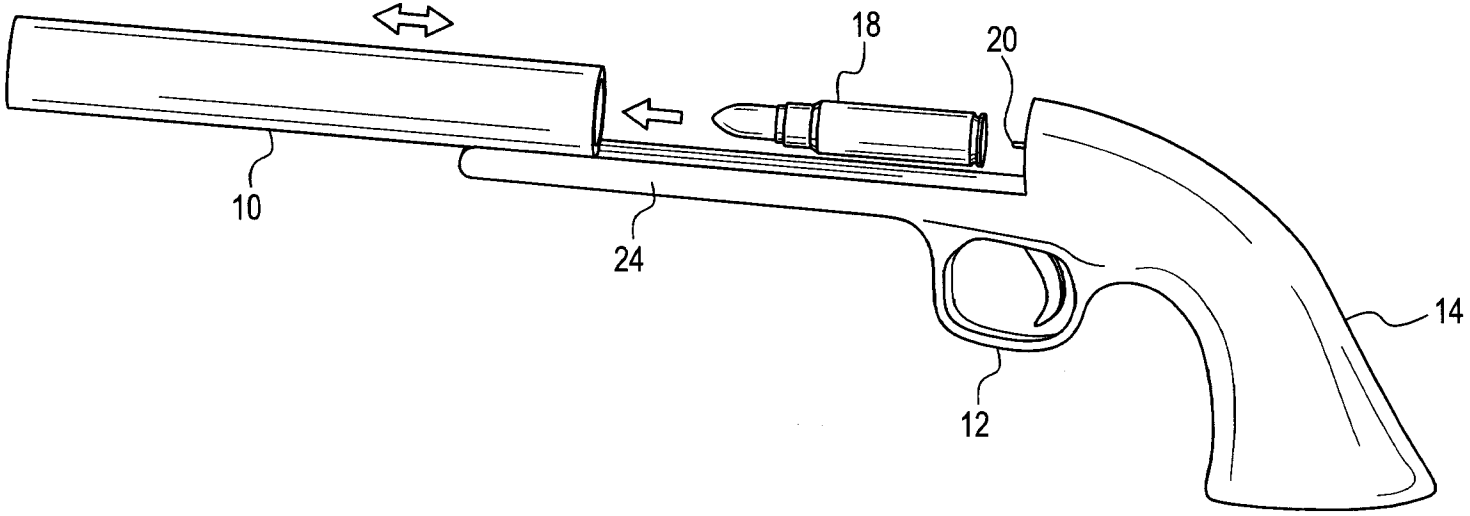
FIG. 2 depicts a perspective view of one example of a multi-caliber breach-loading (load from the rear of the barrel), break-action (barrel and action are brought together via a hinge system) barrel device according to various embodiments described herein.

FIG. 2 presents another embodiment of a barrel device on a firearm whereby the barrel device 10 is connected and slides down a rail 24 and is secured to the action 12 prior to firing which is attached to the handle 14. The rail 24 could also be situated on top. In both FIG. 1 and FIG. 2, the cartridge 18 will be centered in the barrel device so the firing pin 20 of the action 12 will strike the primer of the cartridge 18.

As presented in the embodiments depicted in both FIGS. 1 and 2, the barrel device is stock and action agnostic so that any type of stock or handle 14 and action 12 can be used with the barrel device 10 as long as the barrel device can be secured to the action 12 to permit the firing pin 20 to center-strike the primer of the cartridge.

Figure 3A:
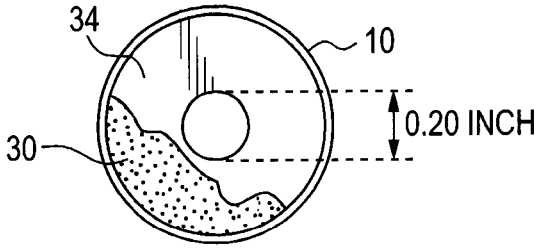
FIG. 3A shows a cross section view of one example of a barrel device without a cartridge loaded according to various embodiments described herein.
Figure 3B:
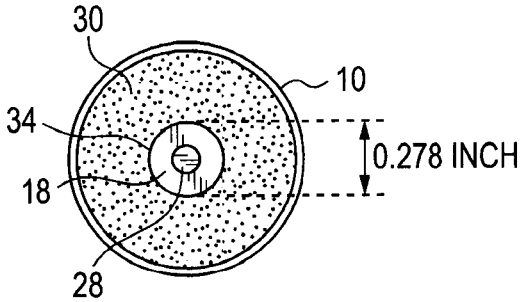
FIG. 3B depicts a cross section view of one example of a barrel device with a centerfire .22 cartridge loaded according to various embodiments described herein.
Figure 3C:
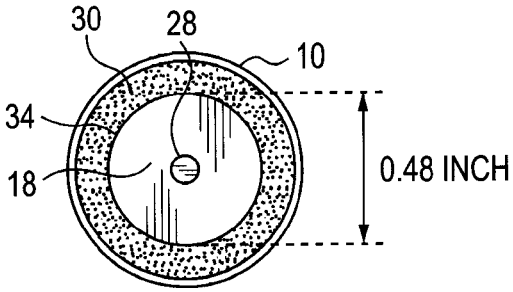
FIG. 3C depicts a cross section view of one example of a barrel device with a .45 caliber cartridge loaded according to various embodiments described herein.

FIG. 3A shows an example of a cross section of the concept's barrel device 10 without a cartridge with a nominal opening diameter according to some embodiments described herein. In this embodiment, the barrel device comprises a non-newtonian type of fluid 30 that can be compressed to accommodate standard centerfire .22 to .45 caliber cartridges 18 as shown in FIGS. 3B and 3C. There are four categories on non-newtonian fluids, only two of them are relevant for use in this present invention; a Rheopectic and a Dilatant. Both these fluids react to increased force by raising their viscosity. Common examples of non-newtonian fluids in these categories range from toothpaste to silly putty to oobleck.

Note that in FIGS. 3B and 3C the .45's rim diameter is 0.48 inches and the .22's rim diameter is 0.278 inches. FIGS. 3B and 3C also show how any caliber cartridge may be centered so its primer 28 will be aligned with the firing pin 20 (FIGS. 1 and 2) of the weapon. FIGS. 3A, 3B and 3C show a preferred embodiment of a barrel device comprising a thin para-aramid synthetic fiber lining 34 (common name is Kevlar) that will go between the non-newtonian type of fluid 30 and the cartridge 18. Aramid fibers are strong, lightweight and are heat resistant. In preferred embodiments, the para-aramid synthetic fiber lining 34 will be in an overlapping circular (tube) shape so as to expand or contract depending on the size of the inserted cartridge 18 and yet retain and secure the non-newtonian type of fluid 30 encasing the cartridge 18 within the barrel device 10.

Figure 4A:
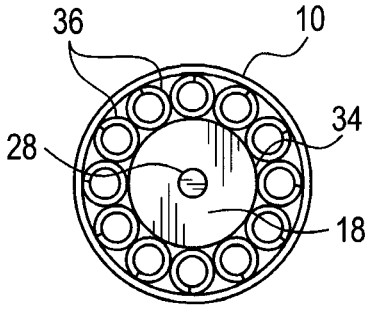
FIG. 4A depicts a cross section view of one example of a barrel device with a cartridge loaded according to various embodiments described herein.

FIG. 4A shows a cross section of an example of a mechanical approach to the present invention's barrel device according to embodiments described herein comprising a barrel device 10 using mechanical construct 36 to center the cartridge in the barrel. This mechanical construct 36 is in the embodiment is coiled springs. While the springs 36 are attached to the inside of the barrel device 10, they are still flexible enough to allow compression when a larger caliber size cartridge is inserted. The springs can be off-centered inside the barrel to provide a rifling effect. While the immediate invention is considered short range, a refinement on rifling will assist with increased range and accuracy.

Figure 4B:
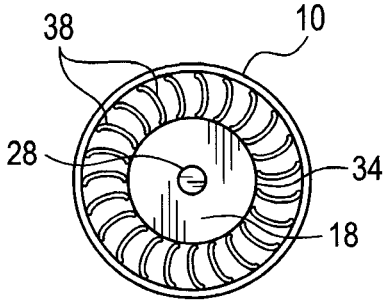
FIG. 4B depicts a cross section view of one example of a barrel device with a cartridge loaded according to various embodiments described herein.

FIG. 4B shows a cross section of another example of a mechanical approach to the present invention's barrel device according to embodiment's described herein comprising a barrel device 10 using mechanical construct 38 to center the cartridge in the barrel. This mechanical construct 38 is in the embodiment of flexible curved material that can accept cartridges of various diameters. While the curved material 38 are attached to the inside of the barrel device 10, they are still flexible enough to allow compression when a larger caliber size cartridge is inserted. In this instance a twisting motion of the cartridge will be necessary for insertion.

In both cases the primer of the cartridge 28 is centered and will be struck by the firing pin 20 (FIGS. 1 and 2) of the firearm. While the mechanical means previously mentioned will suffice to center, secure, and counteract the pressure of the fired round, in some embodiments, a para-aramid synthetic fiber lining 34 could also be used in same same fashion as in the non-newtonian fluid examples. This overlapping circular fiber 34 will be between the mechanical construct 36, 38 and the cartridge 18.

In preferred embodiments, such as those depicted in FIG. 4, the barrel device comprises a mechanical means of coiled springs to center the cartridge 18 within the barrel device. The springs can be made of a metal alloy material and as mentioned previously will be secured to the inside of the barrel device.

Combining the mechanical and non-newtonian fluid is another possibility. This will afford a means to keep the non-newtonian fluid secured inside the barrel (assuming the mechanical is already secured) and will provide a means to keep the pressure of the fired round acting on the bullet vice escaping around the cartridge.

Figure 5:
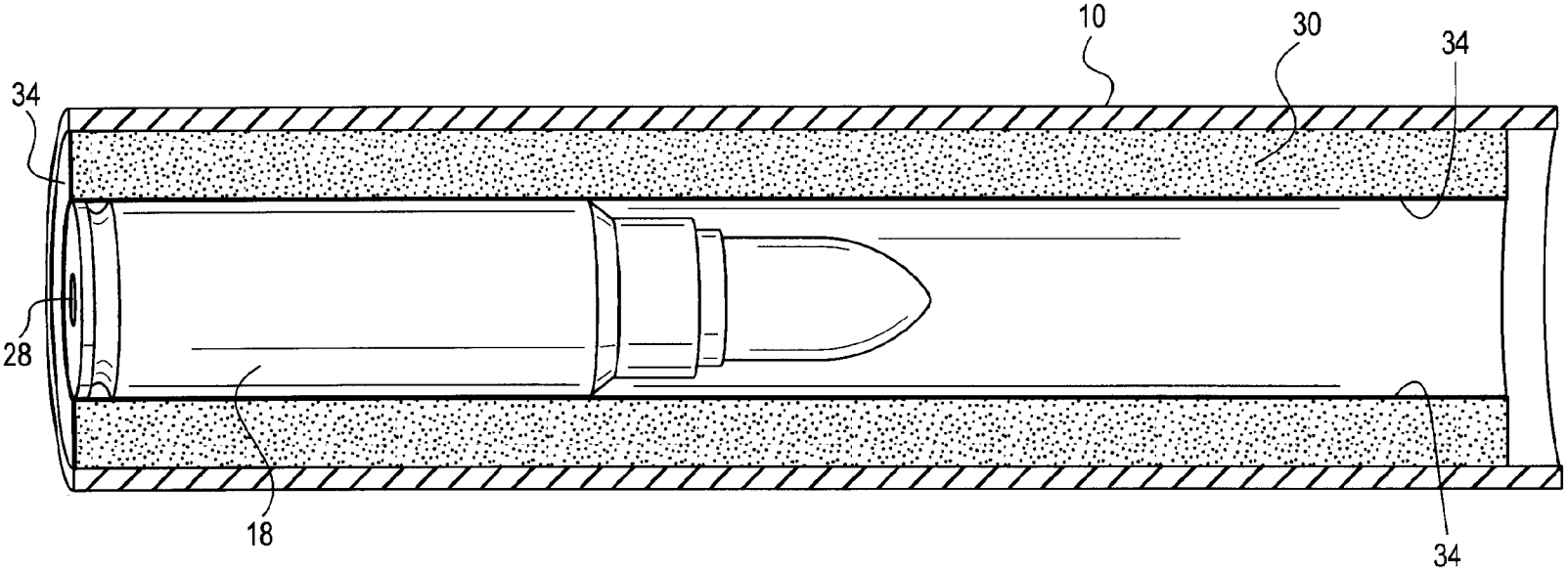
FIG. 5 presents a side cross section view of one example of a barrel device with a cartridge loaded according to various embodiments described herein.

FIG. 5 depicts a side cross section of an embodiment of a barrel device 10 comprising the non-newtonian type of fluid or even a type of foam material 30. The centering material that goes inside the barrel device needs to be of such a construct (non-newtonian fluid or a foam type material) that allows a cartridge 18 to be loaded, held firmly in place in the center of the barrel device 10 and be unloaded after firing. The non-newtonian type of fluid or foam 30 will adapt to the cartridge's 18 shape inside the barrel device 10. Just as in the mechanical embodiments described in FIGS. 4A and 4B, the para-aramid synthetic fiber lining 34 provides an additional protection that will be able to withstand the temperature and radial pressure of the fired cartridge 18. While the non-newtonian type of fluid or foam 30 is pliable to host an inserted cartridge 18, the radially fast pressure of a "fired" cartridge 18 should be such as to not allow the non-newtonian type of fluid or foam 30 to appreciably move thus containing the fired cartridge's pressure.

Figure 6:
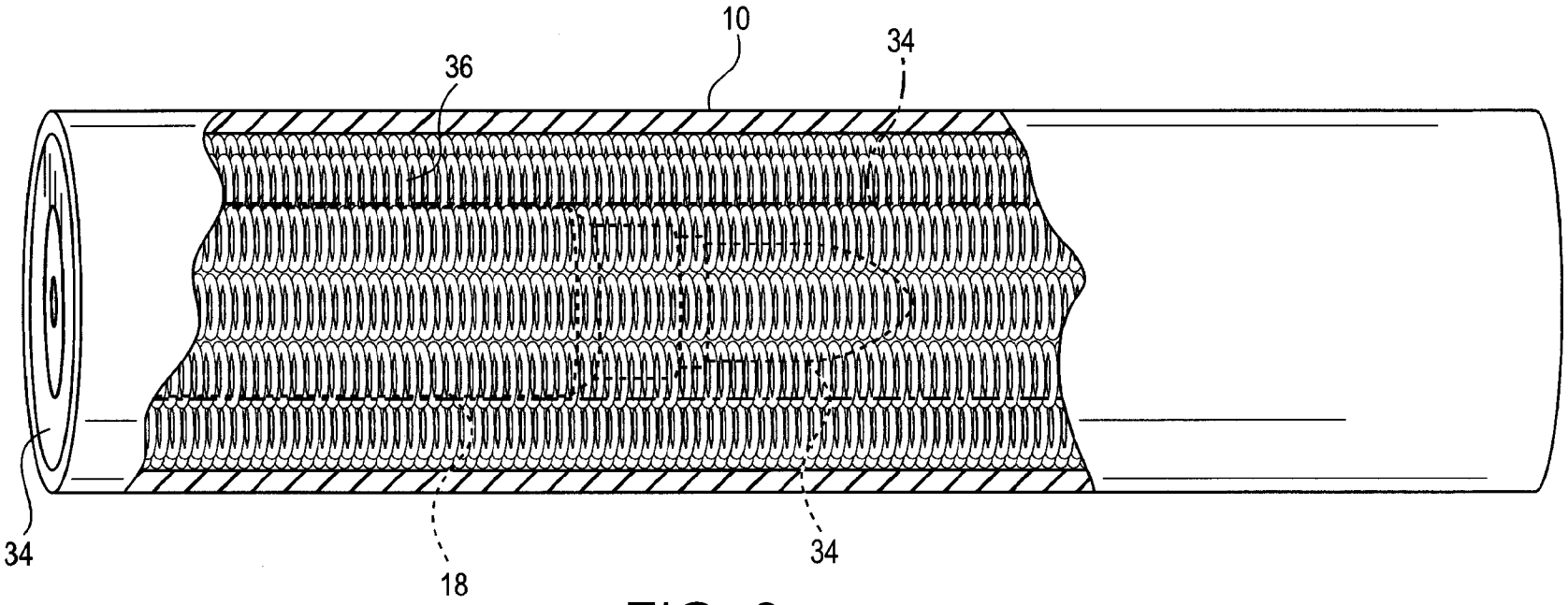
FIG. 6 presents a cut-away side view of one example of a barrel device with a cartridge loaded according to various embodiments described herein.

FIG. 6 illustrates a side cross section view of one example of a barrel device 10 with a cartridge 18 loaded according to various embodiments described herein. In this preferred embodiment, a mechanical construct 36 is used to center a cartridge within the barrel device. The mechanical construct 36 will also allow a cartridge to be loaded, held firmly in place in the center of the barrel device and be unloaded after firing. The mechanical construct 36 may comprise a plurality of coiled metallic springs that can be compressed and then go back to their original shape. In some embodiments, a tubular round and overlapping para-aramid synthetic fiber lining 34 can be used between the coiled metal springs and the cartridge. The mechanical construct 36 and the para-aramid synthetic fiber lining 34 will contain the pressure from the fired cartridge and make loading and unloading of the cartridge 18 easier. It may be feasible that the mechanical construct does not require a synthetic fiber lining.

As shown in the embodiments depicted in FIGS. 5 and 6, the barrel device may use mechanical construct 36 and 38 or a foam or non-newtonian type of fluid 30. In other embodiments, a barrel device may comprise both a non-newtonian type of fluid 30 and a mechanical construct 36 or 38 such as coiled springs with or without a para-aramid synthetic fiber lining 34.

The present invention may be embodied in other specific forms without departing from the spirit or essential attributes thereof and accordingly, reference should be made to the appended claims rather than to the foregoing specification as indicating the scope of the invention.

I claim:

1. A firearm capable of firing ammunition of various different caliber, said weapon comprising:

a barrel that will accept multiple different size or caliber ammunition or cartridges;

said barrel having an interior lined with a non-newtonian fluid and a para-aramid synthetic fiber lining containing the non-newtonian fluid; said fluid and lining being secured to said barrel at both ends of said barrel, and wherein said fluid and lining are capable of centering and firmly holding the cartridge in the middle of the barrel.

2. The firearm capable of firing ammunition of various different caliber of claim 1, wherein the non-newtonian fluid is a Rheopectic fluid.

3. The firearm capable of firing ammunition of various different caliber of claim 1, wherein the non-newtonian fluid is a Dilatant fluid.

4. The firearm capable of firing ammunition of various different caliber of claim 1, wherein the para-aramid synthetic lining is in an overlapping circular shape.

5. The firearm capable of firing ammunition of various different caliber of claim 1, wherein the non-newtonian fluid is confined within the barrel by coiled springs that run laterally along the length of the barrel and are attached to the barrel.

* * * * *